United States Patent [19]

MacWatt

[11] Patent Number: 5,007,325

[45] Date of Patent: Apr. 16, 1991

[54] APPARATUS FOR CLEARING MINES

[75] Inventor: David M. MacWatt, Elgin, Scotland

[73] Assignee: Aardvark Clear Mine Limited of Shevock Farm, Insch, Scotland

[21] Appl. No.: 485,776

[22] Filed: Feb. 22, 1990

Related U.S. Application Data

[63] Continuation of Ser. No. 380,778, Jul. 18, 1989, abandoned, which is a continuation of Ser. No. 170,066, Mar. 14, 1988, abandoned, which is a continuation of Ser. No. 816,206, Jan. 6, 1986, abandoned.

[30] Foreign Application Priority Data

Jan. 10, 1985 [GB] United Kingdom ..... 8500569

[51] Int. Cl.[5] ..... F41H 11/16

[52] U.S. Cl. ..... 89/1.13

[58] Field of Search ..... 89/1.1 B

[56] References Cited

U.S. PATENT DOCUMENTS

| | | | |
|---|---|---|---|
| 913,979 | 3/1909 | Reichman | 89/1.13 X |
| 1,035,056 | 8/1912 | Shubert et al. | 89/1.13 X |
| 1,542,963 | 6/1925 | Russell | 89/1.13 X |
| 1,807,150 | 5/1931 | Caldwell | 89/1.13 X |
| 2,146,101 | 2/1939 | Weber | 89/1.13 X |
| 2,489,564 | 11/1949 | Dutoit | 89/1.13 |
| 2,496,423 | 2/1950 | Taylor | 89/1.13 |

FOREIGN PATENT DOCUMENTS

| | | | |
|---|---|---|---|
| 2052900 | 5/1972 | Fed. Rep. of Germany | 89/1.13 |
| 2430709 | 1/1976 | Fed. Rep. of Germany | 89/1.13 |
| 2507351 | 9/1976 | Fed. Rep. of Germany | 89/36.08 |
| 3127856 | 2/1983 | Fed. Rep. of Germany | 89/1.13 |
| 1157301 | 5/1958 | France | 89/1.13 |

OTHER PUBLICATIONS

Richmond Times Dispatch—Jun. 30, 1944, p. 3.
Popular Mechanics—Sep. 1944, p. 6.
U.S. Naval Inst. Proceedings—Sep. 1944, p. 1190.

*Primary Examiner*—David H. Brown
*Attorney, Agent, or Firm*—Ratner & Prestia

[57] ABSTRACT

A flail vehicle comprising a tractor unit and rotatable ground-beating means at one end of the tractor unit, the ground-beating means having a rotatable shaft from which extend flexible ground-beating members, wherein adjacent ground-beating members are offset angularly around the shaft from one another at their connections to the shaft.

4 Claims, 7 Drawing Sheets

APPARATUS FOR CLEARING MINES

This application is a continuation of application Ser. No. 380,778 filed Jul. 18, 1989 which is a continuation of Ser. No. 170,066, filed Mar. 14, 1988, which is a continuation of Ser. No. 816,206, filed Jan. 6, 1986, all now abandoned.

This invention relates to a vehicle for use in clearing mines.

It has been proposed to clear mines by using a flail mounted at the forward end of a tractor or tank, the flail consisting of a number of chains attached at one end to a rotatable shaft, the other ends of the chains being free. The shaft in use is rotated at a height above the ground less than the length of the chains, so that the free ends of the chains beat the ground and detonate any mines which are present.

The working life of the chains of such flails has been severely limited due to damage resulting from detonation of mines. In particular substantial damage is done to a number of chains by each detonation in view of the gas and blast which removes several links of chains in contact with the mine. In the past, therefore, the long-term effectiveness of the flails has been in doubt since explosion damage to the chains prevents a regular beat pattern from being maintained; thus live mines can escape detonation by virtue of damaged chains passing over them without contact.

According to the present invention there is provided a flail vehicle comprising a tractor unit, and rotatable ground-beating means at one end of the tractor unit, the ground-beating means having a rotatable shaft from which extend flexible ground-beating members, adjacent ground-beating members being offset angularly around the shaft from one another at their connections to the shaft.

Preferably the ground-beating menbers are chains.

Preferably also the ground-beating members are connected to the shaft at helically-arranged locations to provide a regular helical pattern of said connections on the shaft.

The offset relationship of adjacent ground-beating members on the shaft does not prevent two or more spaced members being connected linearly of the shaft and not therefore offset, but preferably such linearly-connected members are spaced from each other by at least 30 cms along the shaft. By having the adjacent ground-beating members offset angularly around the shaft, explosion damage is restricted and centred on the member whose flailing action detonates a mine. Adjacent members are either angularly ahead of or behind the detonating member and do not therefore receive the full effect of the explosion. Indeed, it is possible for the adjacent members to be spaced above the ground at the moment of detonation, and damage to these members can therefore be substantially avoided.

Preferably more than 5, and most effectively 8, ground-beating members are connected along each 300 mm length of the shaft. The connections of the adjacent ground-beating members on the shaft are preferably spaced by less than 10 cms, most preferably about 3 to 4 cms. The ground-beating means is preferably disposed at an end of the tractor unit remote from the prime mover of the tractor unit, in order to protect the prime mover from the effect of explosions and to counterbalance the weight of the ground-engaging means.

The shaft may be rotatable on a pair of side arms expending between the shaft and a main body of the tractor unit; these side arms are preferably pivotable on the main body so that blast resulting from mine detonation can be absorbed by upward pivoting of the arms. If the arms are pivotal the ground-engaging means can also be adjusted in height to respond to variations in the contour of the terrain over which the vehicle passes. Further, the arms may pivot into an out-of-use position in which they raise the shaft so that it rests on the body of the tractor unit.

The side arms may also be telescopic so as to allow the shaft to be retracted towards the body of the tractor unit for storage or transport. Portions of the arms may be made of non-ferrous material for effective detonation of magnetic mines. Telscopic movement of the arms may be effected by hydraulic rams.

The ground-beating means is preferably driven from the prime mover of the tractor unit.

The ground-beating means may be driven by a hydraulic pump which is preferably disposed adjacent the tractor unit's prime mover. The pump is preferably driven directly from the prime mover, for example from the crankshaft of the engine of the tractor.

The flail vehicle of this invention may be used in mine clearance or for clearing a pathway through a fire-stricken area; in the latter case the ground-beating means may have a cooling water spray directied against it and a spoil plate to deflect debris thrown up by the ground-beating members. A steel deflector plate is preferably provided on the mine clearance version of the vehicle to deflect the blast of explosions, and the spoil plate of the firefighting version may be provided at a similar location on the tractor unit.

Embodiments of this invention will now be described, by way of example, with reference to the accompanying drawings, in which.

Figure 1:
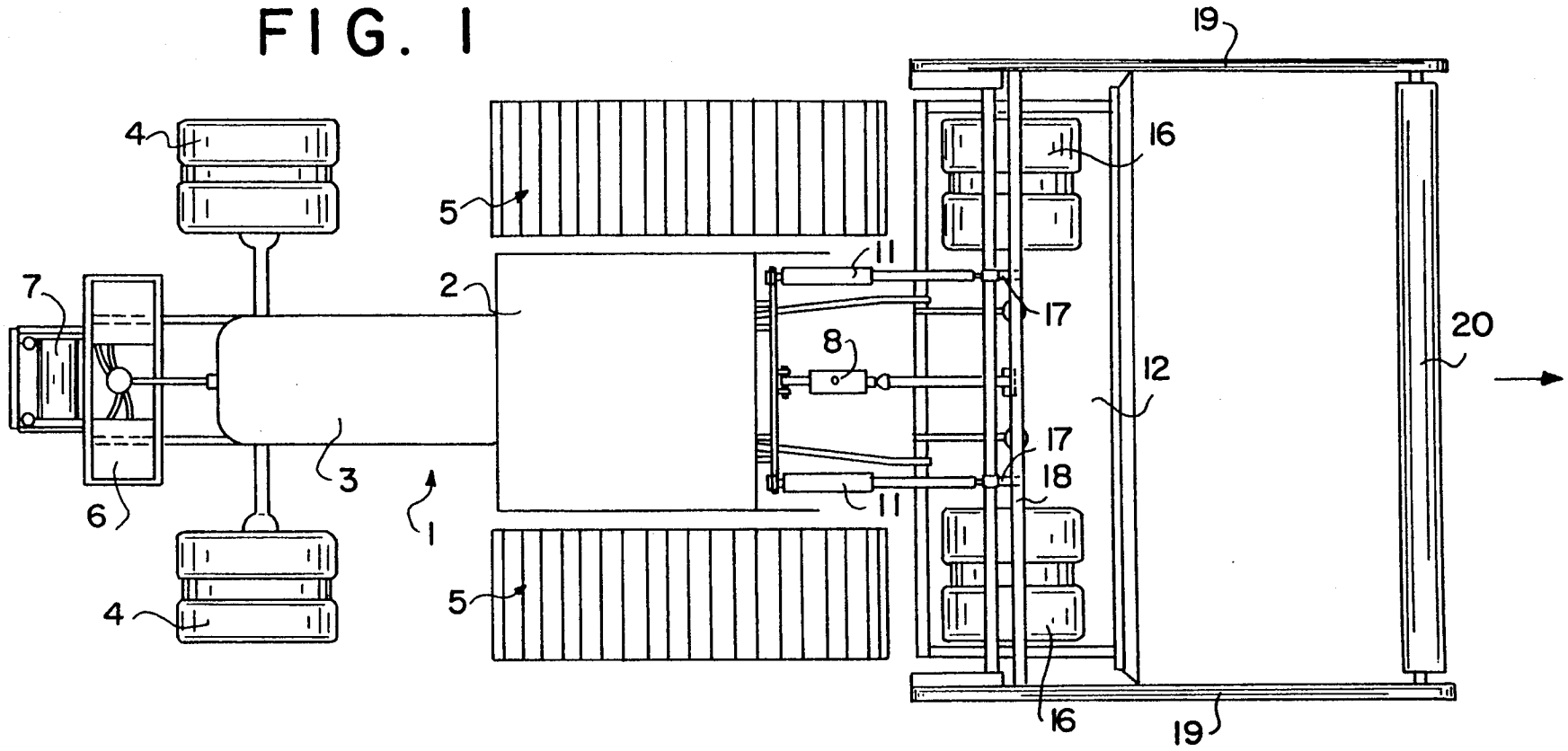
FIG. 1 is a plan view of a first embodiment of a vehicle of the present invention for use in clearing mines.
Figure 2:
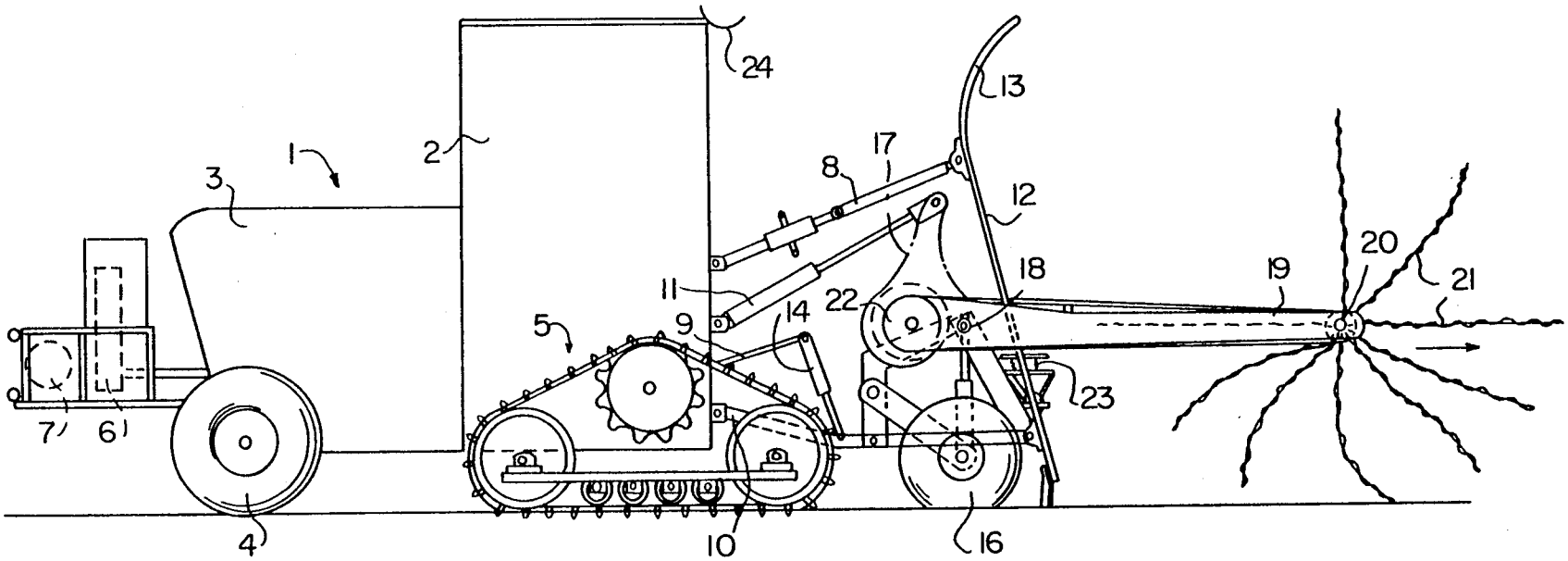
FIG. 2 is a side view corresponding to FIG. 1.

Referring to FIGS. 1 and 2, the vehicle of the first embodiment of the invention has an agricultural tractor 1 having a cab 2 and an engine compartment 3. The tractor 1 has front road wheels 4 and rear continous-track units 5 for ease of movement over uneven terrain. A hydraulic pump 6 is mounted adjacent the engine compartment 3 at the forward end of the tractor 1 and is driven directly from the crankshaft of the engine. A winch 7 is also mounted at the front of the tractor 1 for towing purposes.

Brackets are secured at the rear of the tractor cab 2 on structural members and have bolted to them at each side of the tractor 1 struts 8, 9 and 10 and a pair of hydraulic rams 11. The struts 8 and 9 support a baffle plate 12 which extends across the entire width of the tractor 1 and which terminates at its upper portion in a mesh panel 13. The strut 10 is pivotally connected to a cylinder-and-ram arrangement 14 which is in turn pivotally connected to the strut 9. The connection of the strut 9 with the baffle plate 12 is common to one point of a three-point linkage which carries a terrain-following wheel 16, the arrangement being such that the wheels 16 move up and down in response to undulations in the ground, and this causes the baffle plate 12 to move with the wheels.

The hydraulic rams 11 are connected to bell-crank levers 17 pivotal about an axis 18 and carrying support arms 19 between whose free ends is a pivotal shaft 20. This shaft 20 carries a number of chains 21 and is driven by a drive belt from a hydraulic motor 22 powered from the hydraulic pump 6.

Spring-loaded carriers 23 are mounted on the baffle plate 12 to receive the support arms 19.

In use, the vehicle of the first embodiment is driven in reverse across a minefield so as to cover the minefield in a predetermined pattern. The hydraulic pump 6 is driven from the crankshaft and powers the motor 22 which rotates the shaft 20. This causes the chains 21 to beat the ground with a flailing action, thus detonating mines which they encounter. The baffle plate 12 provides a shield from the blast for the tractor driver and the equipment other than the flail itself and its support arms 19. In use the arms 19 are controlled in angle by the effect of the chains 21 on the ground, and thus "float" to retain the shaft 20 at the desired height above the ground. If a mine is detonated by the chains 21 the arms 19 can pivot upwardly to absorb the effect of the explosion, and in this the hydraulic rams 11 can act as shock abosrbers to dampen the movement of the arms 19.

When not in use the mine-clearing apparatus can be simply and quickly disconnected from the tractor 1 by removing the bolts holding the strut 8 and the ram 11 on the brackets at the rear of the cab 2 and a bolt midway along the strut 10, and disconnecting the hydraulic line between the pump 6 and the motor 22. The tractor 1 can then be driven away for other duties.

When the vehicle of the first embodiment is to be driven from one site to another the mine-clearing equipment can be moved to an out-of-use position by retracting the hydraulic rams 11, thus pulling the bell-crank levers 17 and pivoting the support arms 19 about the axis 18. This pivoting continues until the shaft 20 engages in a cradle 24 on the cab 2. The terrain-following wheels 16 are also retracted from their in-use position by pivoting the strut 10 upwardly about its bracket at the rear of the cab 2. This frees the tractor's power take-off for other uses.

The direct connection of the hydraulic pump 6 to the tractor's crankshaft makes the equipment more efficient than if the connection was through the power take-off, and the mounting of the flail at the rear of the tractor allows excellent weight distribution.

The shaft 20 and its chains 21 are of the same construction and assembly as will be described below with reference to FIG. 3 for the rotor 40 and chains 21.

Referring to FIGS. 3, 4, 5 and 6, the apparatus for clearing mines of the second embodiment of the invention has a boom assembly 30, a sub-frame assembly 31, a rear skid-frame assembly 32, a front skid-frame assembly 33, and a hydraulic system 34.

The boom assembly 30 has a main boom structure 35 and two boom extensions 36, 37 between whose free ends 38, 39 is a rotor 40. Lugs 41 integral with the rotor 40 extend radially outwardly from the rotor surface. The lugs 41 are disposed in helical formation on the rotor surface, adjacent lugs 41 being angularly spaced by 30° around the rotor and disposed 3.5 cm axially apart. The helical arrangement is such that no two lugs 41 are linearly spaced along the rotor surface less than 45 cm apart. The rotor 40 is 3 m in length and lugs are linearly spaced at equal intervals of 45 cm along it.

This helical arrangement of the lugs 41 ensures that in use when the rotor 40 is at its optimum working distance above the ground the chains beat a regular and very dense flail pattern, but when any one chain 21 is in contact with the ground and therefore liable to damage should it detonate a mine the immediately adjacent chains are either ahead of it or behind it in rotation. The adjacent chains are therefore clear of the ground at that point and less likely to be damaged or broken by detonation. Thus only the linearly-spaced chains 45 cm apart contact the ground simultaneously, and these are sufficiently far apart to avoid damage to more than one chain should detonation occur. The lugs 41 provided on the rotor 40 are designed to eliminate wear to the rotor 40. All wear is taken up on a chain interlink **41*a* and on the shank of a fixing bolt 41*b*. The rotor 40 is provided with a pulley 42 which is driven by a number of 'V' belts 43 mounted within the boom extension 36, 37 and the main boom structure 35**.

The 'V' belts 43 are in turn driven by a second pulley 44 in the main boom structure 35. This pulley 44 is driven via a rubber coupling 45 driven by a toothed wheel 46 in turn driven via a tooth belt 47 from a gearbox 48.

A power take-off (PTO) shaft 49 transfers power from the PTO point of a tractor, for example, to the gearbox 48.

The sub-frame assembly 31 has four fixing caps 52.

The sub-frame assembly 31 features a blast plate 53 which is mounted on rubber springs 54, 55 which cushion the blast plate 53 from the boom assembly 30.

Boom lifting rams (not shown) and damping rams 56 are provided on the sub-frame **31*a* and are designed to allow the boom assembly 30 to rise without any hydraulic restriction, but to damp the free fall of the boom assembly 30**.

Two jacks 57, 58 are provided at the side of the sub-frame **31*a* can be used to support the weight of the sub-frame assembly 31 and the boom assemblies 30** when the apparatus is not in use.

The rear skid-frame assembly 32 is provided with two tapered square section mounting probes 60, 61. When the sub-frame assembly 30 and boom assembly 31 are in use the probes 60, 61 are mounted within the horizontal square section tubes 62, 63 of the sub-frame **31*a* and held in position by locking pins 64**.

The mounting probes 60, 61 allow the sub-frame assembly 30 and boom assembly 31 to be attached and detached from the tractor quickly.

A control box 70 allows the operator to raise or lower the apparatus and also monitors the tractor's engine speed. The control box 70 can be tuned to a wide range of operating bands.

The use of mechanical drive in this embodiment of the invention eliminates the need for large oil tanks which are required when an oil pump is used. Also, mechanical drive is more reliable and more easily maintained than an oil pump system.

Figure 3:
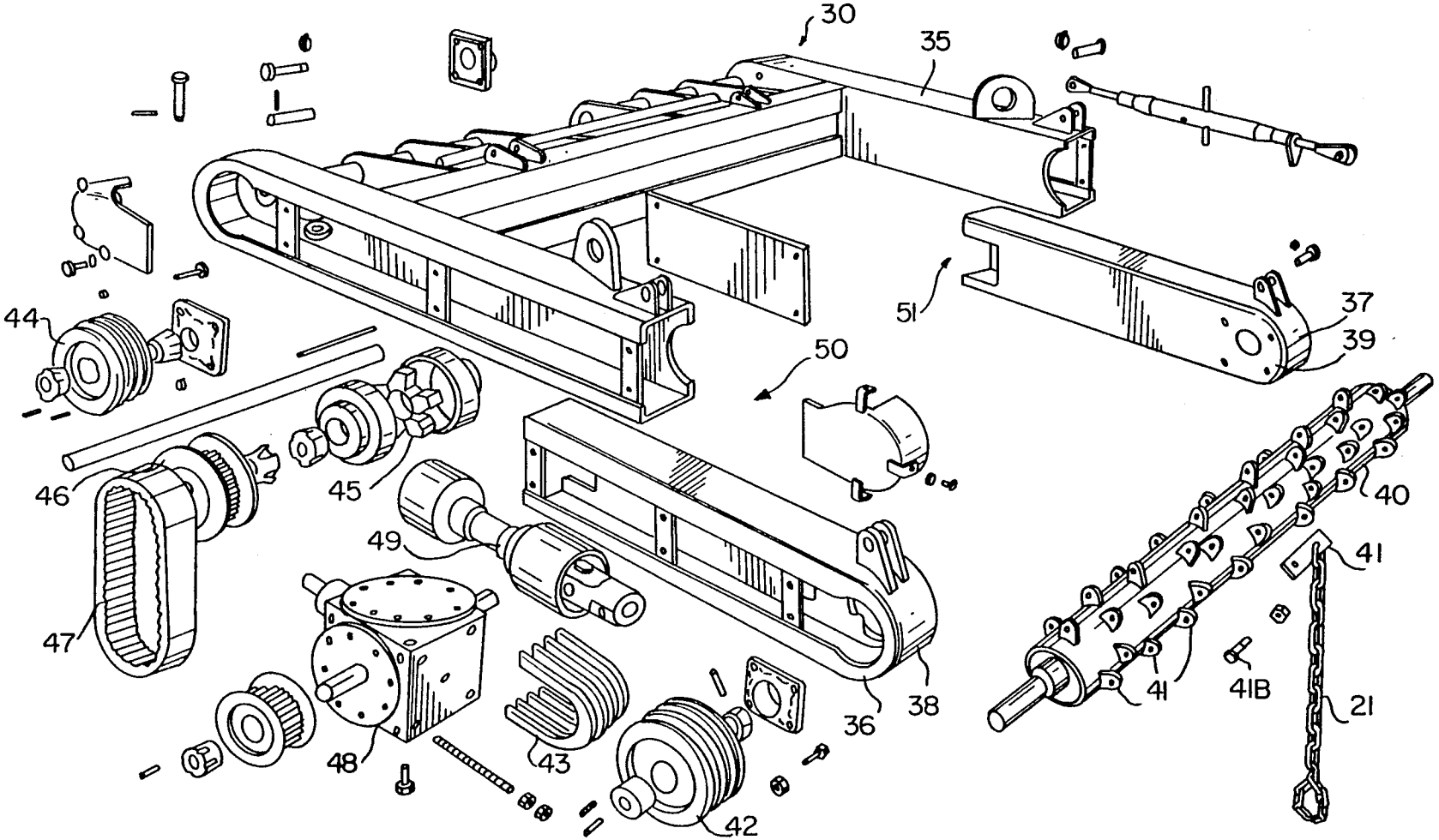
FIG. 3 is an exploded perspective view of a sub-frame assembly of a second embodiment of the present invention.
Figure 4:
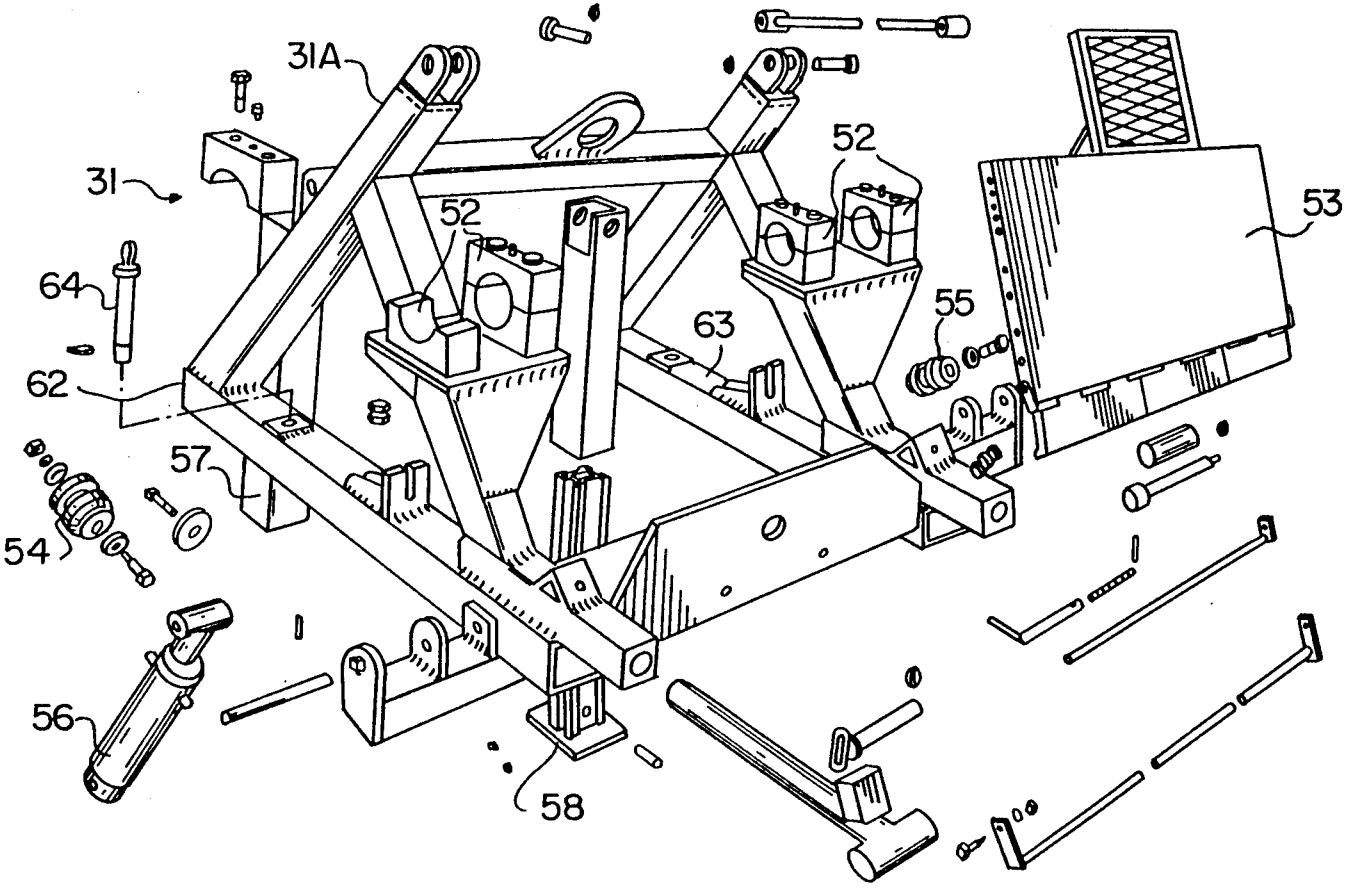
FIG. 4 is an exploded perspective view of a sub-frame assembly of the second embodiment of the present invention.
Figure 5:
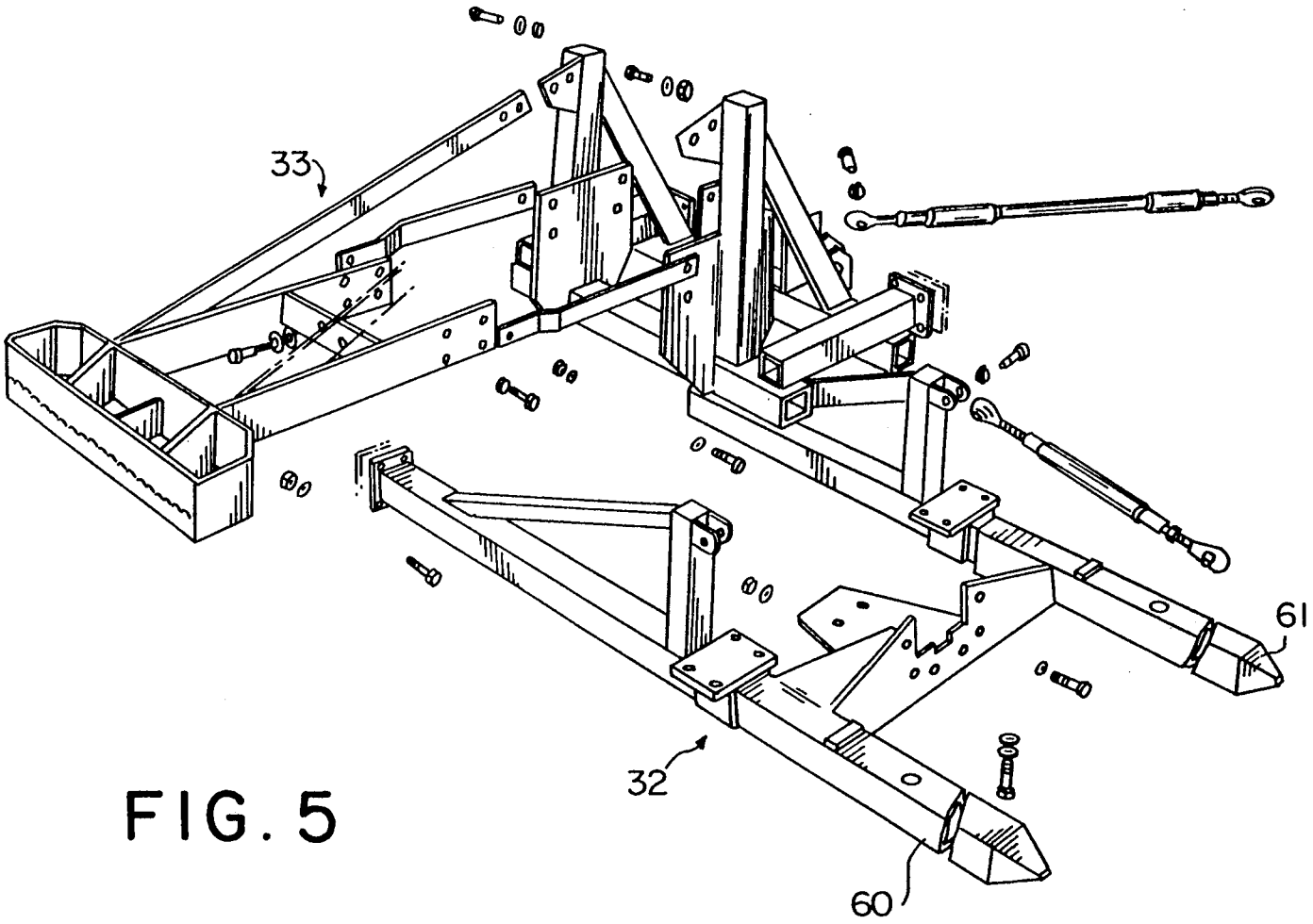
FIG. 5 is an exploded perspective view of the front and rear skid-frame assemblies of the second embodiment of the present invention.
Figure 6:
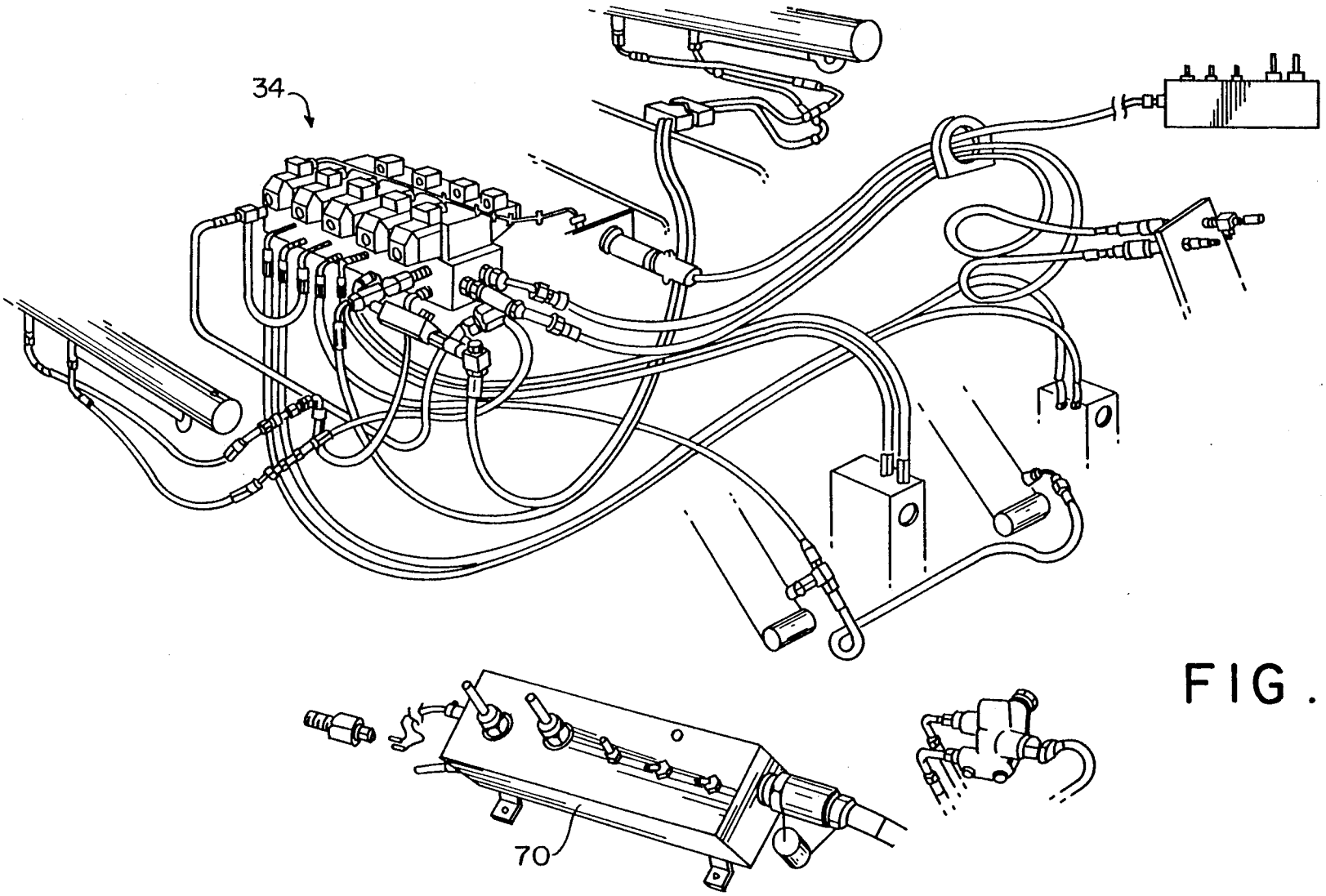
FIG. 6 is a perspective view of a hydraulic control system of the second embodiment of the present invention.
Figure 7:
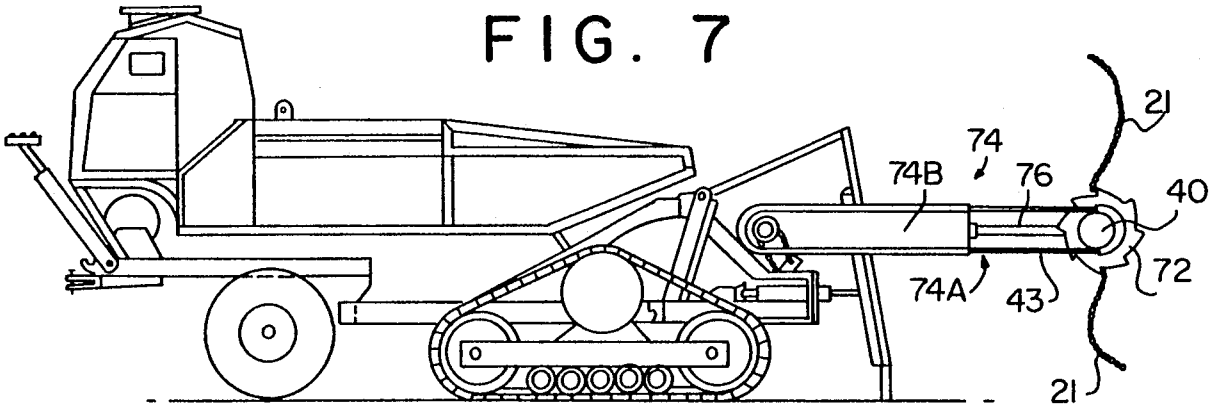
FIG. 7 is a side view of a further embodiment of the flail vehicle of the invention.
Figure 8:
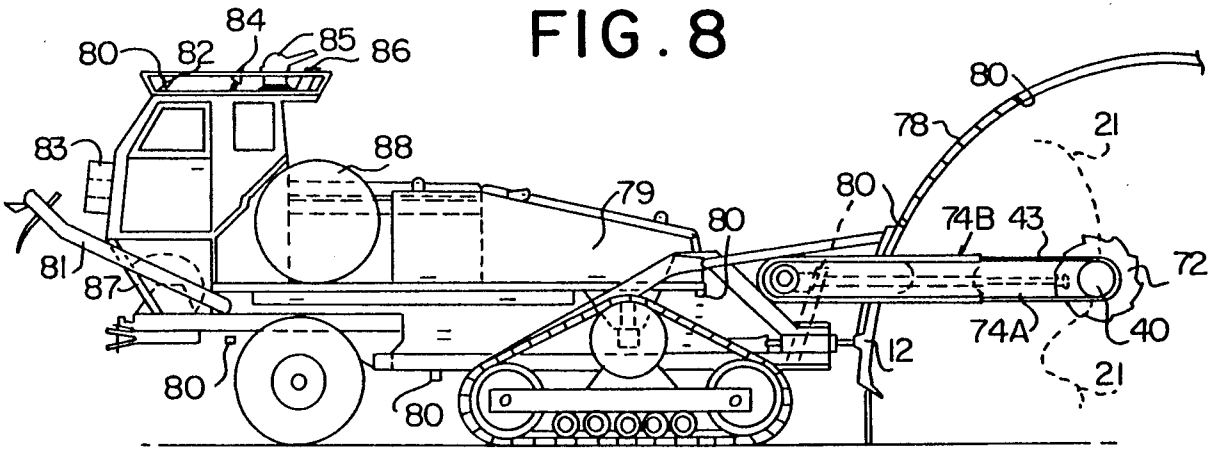
FIG. 8 is a side view of a still further embodiment of the flail vehicle of the invention.

FIGS. 7 and 8 each illustrate flail vehicles whose rotor 40 has the chains 21 arranged substanially in the same number and relationship as shown in FIG. 3 and described above, i.e. with the helical arrangement of the chain connections to the rotor. In FIG. 7 the vehicle is a half-track military vehicle and the rotor 40 has at its ends a pair of wire cutters 72 which rotate with the rotor 40. The rotor in each case is mounted between side arms 74 of telescopic construction, each outer portion 74A extending within the inner portion 74B and movable to extend or retract by means of a hydraulic ram 76. The telescopic construction allows a constant tension to be maintained on the V-belt 43.

The vehicle of FIG. 7 has a rotor 40 which is 3.05 m in length and the vehicle weighs 9500 kg. The rotor has 72 chains connected to it and has an operating speed of up to 270 revolutions per minute, powered by a 120 hp take-off from the vehicle's main engine turning at 1900 revolutions per minute. This vehicle can detonate anti-tank mines buried to a depth of 230 mm. The dense flail pattern of the chains 21 allows single impulse anti-tank mines to be detonated in muddy conditions at a vehicle speed of 4.6 km/h and small anti-personnel mines at a speed of 3.4 km/h.

In FIG. 8 the vehicle of FIG. 7 has been specially adapted for firefighting work and particularly for clearing a pathway through burning scrub or woodland. In this case the deflector plate 12 has an upper portion 78 of mesh which extends over the rotor 40 to deflect debris thrown up by the chains 21. A water tank 79 feeds sprinkler nozzles 80 directed against the rotor 40 and chains 21.

A further deflector plate 81 is provided at the front of the vehicle, and also provided are a periscope 82, a hose reel 83, a lamp 84, a water cannon 85, a flare launcher 86, a front winch 87 and an air filter 88.

Modifications and improvements may be incorporated without departing from the scope of the invention.

What is claimed is:

1. A flail vehicle comprising a tractor unit and rotatable ground-beating means mounted at one end of the tractor unit, the ground-beating means comprising a shaft which is rotatable about a central axis, said central axis being substantially parallel to the ground and transverse to the direction of travel of the vehicle, said shaft carrying a distributed array of flexible flail chains extending radially outwardly from said shaft, each of said flail chains having a direct connection to said shaft, the distribution of flail chains within said array being such that each said connection is angularly and axially offset around and along said shaft from the nearest adjacent said connection, and wherein any two of said connections in said array which are adjacent in a direction substantially parallel to said central axis of the shaft are mutually spaced apart by at least thirty centimeters as measured along the shaft in a direction parallel to said central axis.

2. A flail vehicle according to claim 1, wherein any two of said connections which are adjacent in a direction substantially parallel to said central axis of the shaft are spaced apart by 45 centimeters as measured along the shaft in a direction parallel to said central axis.

3. A flail vehicle according to claim 1, wherein said connections of the flail chains in said distributed array form a helical pattern on the shaft.

4. A flail vehicle according to claim 3, wherein said nearest adjacent connections are mutually separated by an angular spacing of 30° around said central axis and an axial spacing of between 3 and 4 centimeters as measured along the shaft in a direction parallel to said central axis.

* * * * *